US005915981A

United States Patent [19]

Mehta

[11] Patent Number: 5,915,981

[45] **Date of Patent: *Jun. 29, 1999**

[54] ELECTRICAL RECEPTACLE WITH SAFETY SHUTTER

[75] Inventor: Parag J. Mehta, Bellmore, N.Y.

[73] Assignee: Pass & Seymour, Inc., Syracuse, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/665,317

[22] Filed: Jun. 17, 1996

[51] Int. Cl.[6] ..... H01R 13/44

[52] U.S. Cl. ..... 439/137; 439/145

[58] Field of Search ..... 439/145, 137

[56] References Cited

U.S. PATENT DOCUMENTS

| | | | |
|---|---|---|---|
| 4,544,219 | 10/1985 | Barkas | 439/137 |
| 4,749,360 | 6/1988 | Dudley et al. | 439/137 |
| 4,867,694 | 9/1989 | Short | 439/137 |
| 5,006,075 | 4/1991 | Bowden, Jr. | 439/137 |
| 5,020,997 | 6/1991 | Calderara et al. | 439/137 |
| 5,281,156 | 1/1994 | Yi | 439/145 |

*Primary Examiner*—Neil Abrams
*Assistant Examiner*—T C Patel
*Attorney, Agent, or Firm*—Bond, Schoeneck & King, LLP; Stephen B. Salai

[57] ABSTRACT

An electrical receptacle of the type having movable shutter members positioned to prevent insertion of objects other than electric plugs through the plug blade-receiving openings into contact with line terminals. Two identical shutter members, each having a camming portion and a blocking portion, are mutually assembled for relative, linear movement in either of two, opposite directions from a centered position to which they are biased by a pair of coil springs. Rigid objects inserted through the receptacle openings contact an angularly disposed surface on the camming portion of the shutter members, causing lateral movement of the element. When the blades of a plug are inserted, both shutter members move laterally to permit continued advance of the blades into the terminal contacts. When a single object is inserted, the blocking portion of one shutter element prevents advance of the object. A lip on the blocking portion prevents passage of the inserted object around the shutter element. Other features include compatibility of the shutter structure with existing receptacles, including those with straight straps, a one-piece spacer supporting the shutter elements for low-friction movement and ease of automated assembly.

20 Claims, 8 Drawing Sheets

12
16
16'
22
18
20
36
38
38'
44
44'
40
40'
42
42'
34
32
14

ELECTRICAL RECEPTACLE WITH SAFETY SHUTTER

BACKGROUND OF THE INVENTION

The present invention relates to electrical receptacles of the type having slidable shutter mechanisms arranged behind the openings which receive the blades or prongs of an electrical plug connected to the receptacle.

In order to prevent electrical shocks and possible injuries which may result from insertion of an electrically conducting member into the live terminals of an electrical receptacle, shutter mechanisms have been provided as a safety feature. The type of such mechanisms with which the present invention is concerned include a plurality of moveable members which are spring-biased to positions wherein surfaces thereof are located between the plug-receiving openings and the live terminals within the receptacle. The shutter members are moved laterally by objects inserted through the openings in the receptacle cover. However, the structure is such that the shutter members must be moved in unison, as by insertion of plug blades, in order to achieve physical access to and electrical communication with the terminals. That is, when a single shutter member is moved independently by insertion of a device through a single opening, the other shutter member remains stationary with a portion in a blocking position to prevent advance of the device into contact with the receptacle terminals.

It is the object of the present invention to provide an electrical receptacle having a novel and improved safety shutter mechanism, overcoming a number of deficiencies of prior art mechanisms of this type. For example, the shutter mechanism of the present invention is more difficult to defeat than prior art mechanisms intended for the same purpose. In addition, the present shutter mechanism elements are configured and relatively arranged to promote automated assembly of the receptacle, including the shutter elements. Other objects and advantages will be pointed out and described in the following sections of this specification.

SUMMARY OF THE INVENTION

U.S. Pat. No. 5,472,350, of the present applicant and commonly assigned with the present application, discloses a duplex electrical receptacle having a number of unique features, including parts configured to facilitate fully automated assembly, a mounting strap having no bends other than the ground wire attachment portion, and a central opening in the cover exposing a surface portion of the strap to position the adjacent surfaces of the cover and strap in the same plane. The receptacle consists of a back body, mounting strap, a pair of terminals and a cover. A pair of contacts for receiving the grounding prongs of plugs inserted into the receptacle and a screw for connection of a ground wire are included with the strap, and a pair of screws for connection of hot and neutral wires are received in threaded openings in the terminals.

Although many features of the safety shutter structure of the present invention may be incorporated in receptacles of other designs, the following detailed description is directed to incorporation of the present invention in the receptacle of the aforementioned patent. The back body, strap including the grounding contacts and ground wire screw, and the terminals with side screws are identical to those of the U.S. Pat. No. 5,472,350 patent, with the cover somewhat modified for compatibility with the safety shutter structure. The latter comprises four, identical shutter elements, four springs and a spacer member. The design is such that the entire receptacle, including the safety shutter structure, may be assembled in a fully automated manner.

The shutter elements are configured for mutual assembly in pairs, one pair to be placed behind each of the plug-receiving openings of the duplex receptacle. Structural features of the shutter elements cooperate with one another and with the spacer member to provide a number of unique features and advantages. For example, the subassembly consisting of a pair of shutter elements is biased by two opposing springs to a central, rest position from which the elements are laterally movable in both directions. These and other features will be specifically pointed out and described in detail, and thus more readily understood and fully appreciated, in the following Detailed Description, taken in conjunction with the accompanying drawings.

DETAILED DESCRIPTION

Figure 1:
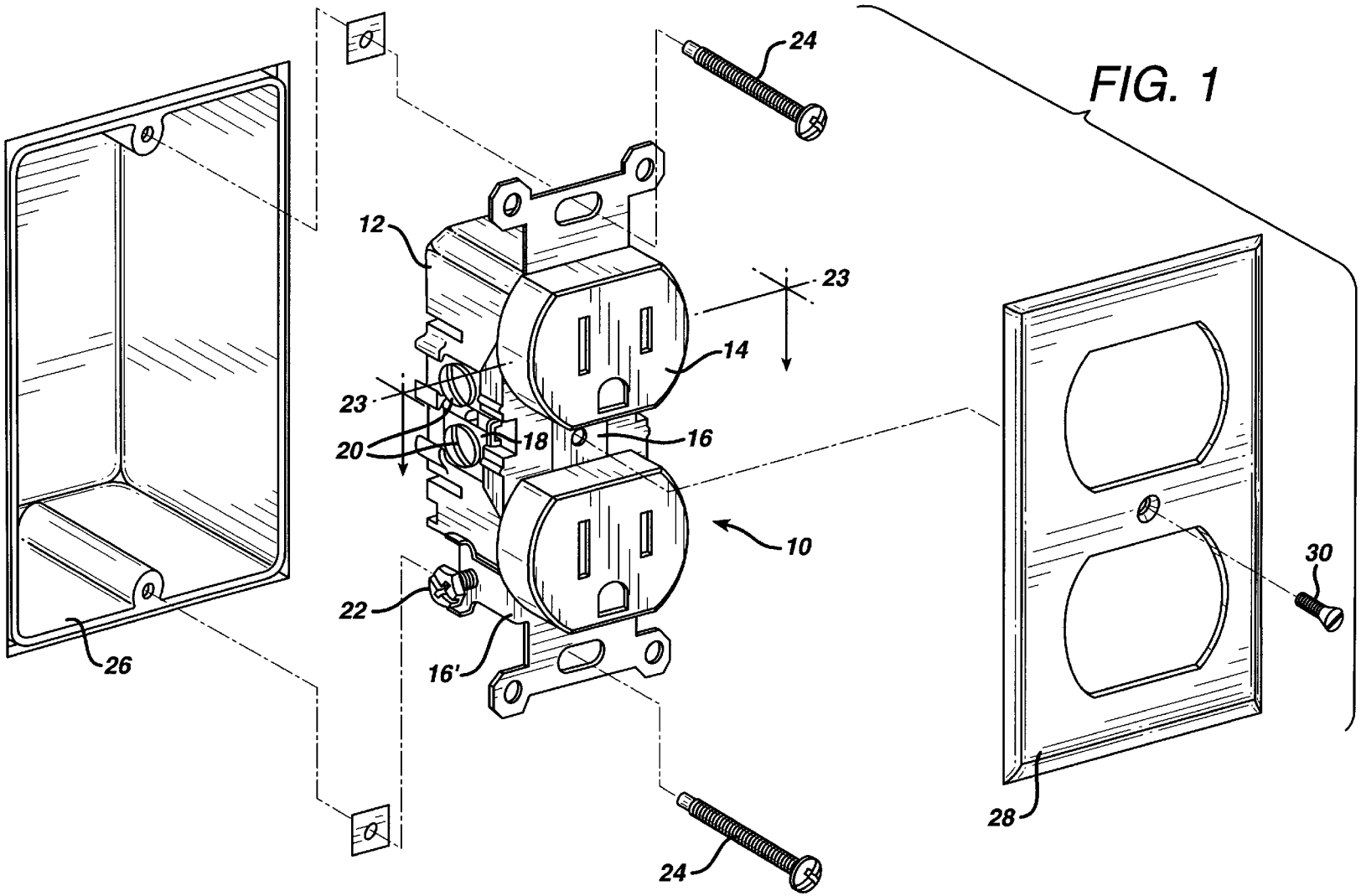
FIG. 1 is an exploded perspective view showing a duplex receptacle, equipped with the safety shutter mechanism of the present invention, with conventional junction box and wall plate.

Referring now to the drawings, in FIG. 1 is seen a duplex wall receptacle indicated generally by reference numeral 10 and containing the safety shutter mechanism of the invention. Visible on the exterior of receptacle 10 in FIG. 1 are back body 12, cover 14, mounting and grounding strap 16, and an exposed portion of terminal 18 having threaded openings for screws 20 by which wires of the electrical circuit which incorporates receptacle 10 may be attached to terminal 18. Similarly, a ground wire may be connected to portion 16' of strap 16 by means of screw 22. Receptacle 10 is mounted by screws 24 in conventional wall or junction box 26, and wall plate 28 is attached to the receptacle by screw 30.

Figure 2:
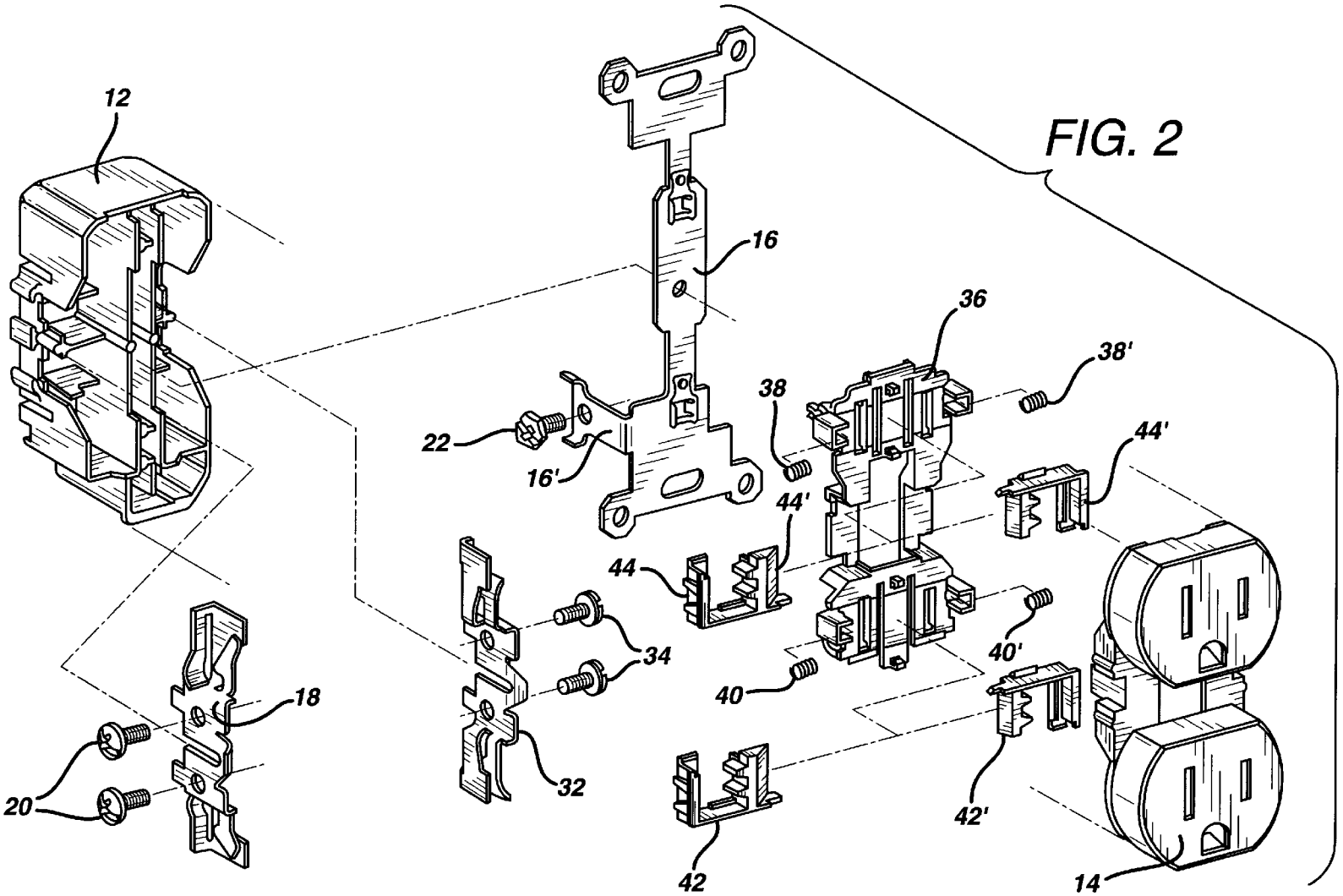
FIG. 2 is an exploded perspective view of the receptacle, including all of the safety shutter elements.
Figure 3:
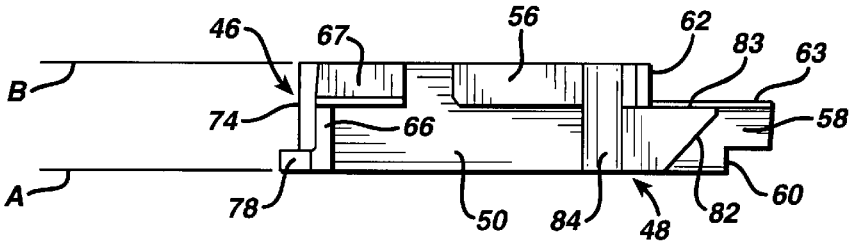
FIGS. 3–8 are front, right side, top, left side, rear and bottom views of a single shutter elements, respectively.
Figure 4:
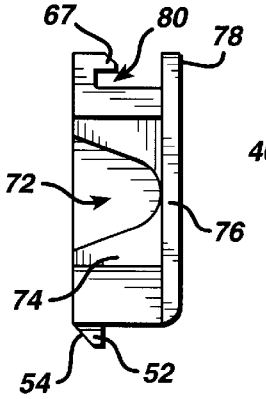
Figure 5:
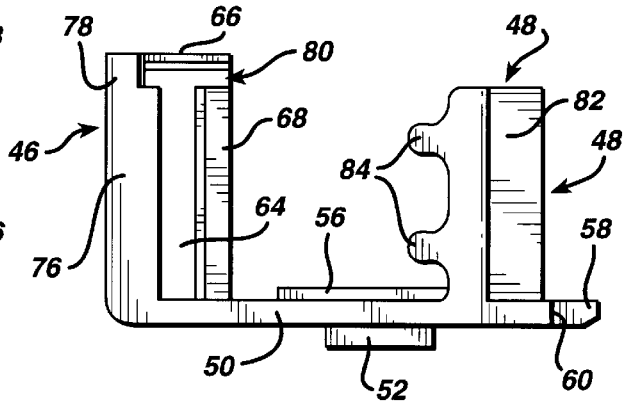
Figure 6:
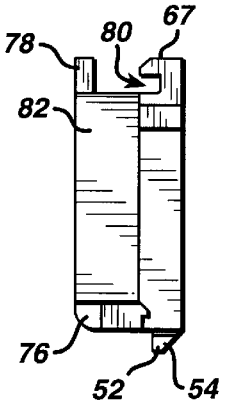
Figure 7:
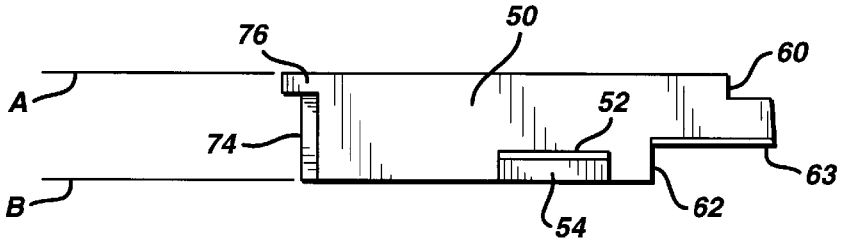
Figure 8:
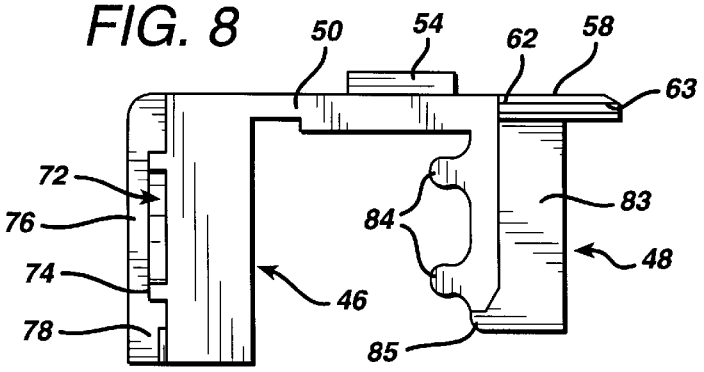
Figure 9:
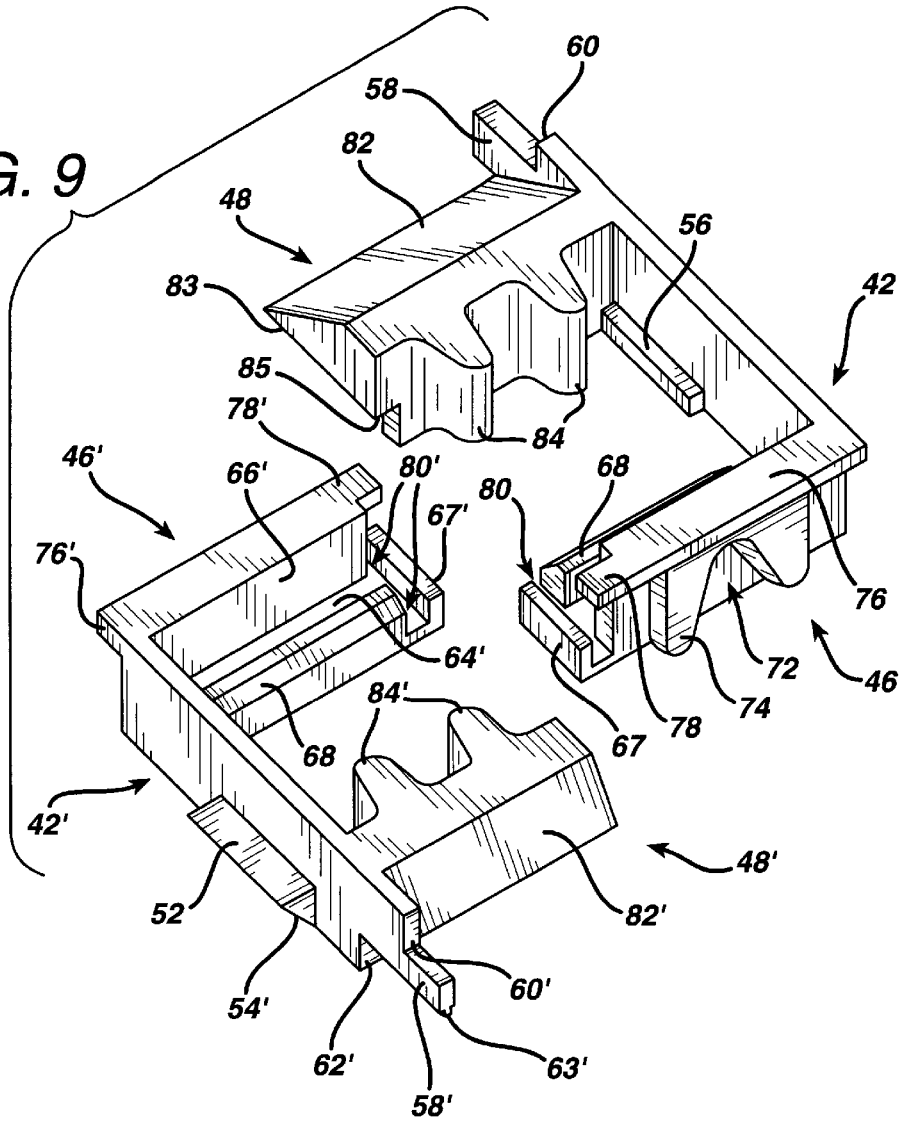
FIG. 9 is a perspective view of a pair of shutter elements in spaced relation prior to mutual assembly.

Elements of receptacle 10 are seen in exploded perspective in FIG. 2. In addition to previously mentioned back body 12, cover 14, strap 16, terminal 18 and screws 20 and 22, the elements comprise terminal 32 with screws 34, spacer member 36, coil springs 38, 38', 40 and 40', and shutter elements 42, 42', 44 and 44'. As previously mentioned, in the disclosed embodiment of receptacle 10, back body 12, strap 16, terminals 18 and 32, and screws 20, 22 and 34 are identical to the receptacle of U.S. Pat. No. 5,472,350; cover 14 is somewhat modified, as explained later, and spacer 36, springs 38, 38', 40, 40' and shutter elements 42, 42', 44, 44' have been added. Springs 38, 38', 40 and 40' are small coil springs, all identical to one another, as are shutter elements 42, 42', 44 and 44'. One of the shutter elements is shown individually in FIGS. 3–8, details of which will now be described with the purpose and function of each significant feature explained later. The configuration of the shutter elements and their cooperative relationship will be better understood with reference to FIGS. 9–13.

Each shutter element is formed as a unitary, plastic molding having three major portions, i.e., arms 46 and 48 and side member 50. Arms 46 and 48 extend in spaced, parallel relation from what is termed the inner surface of side member 50 to free, terminal ends. For reasons which will later become apparent, arms 46 and 48 are termed "blocking" and "camming" portions, respectively, of the shutter elements. Protrusion 52, having angled surface 54, extends from the outer surface of side member 50 at a position intermediate of the ends thereof. It will be understood that the term "angled surface" is used herein to indicate an essentially planar surface arranged at an acute angle with respect to what are termed the outer and inner planes of the shutter element, denoted by letters A and B, respectively, in FIGS. 3 and 7. Ledge 56 on the inner surface of side member 50 extends from arm 48 for a portion of the distance to arm 46. Portion 58 of side member 50 extends past arm 48, and stepped shoulders 60 and 62 are formed inwardly of the free end of portion 58. Rib 63 extends along the edge of portion 58 from shoulder 62 to the free end.

Arm 46 is configured to include ledge 64, extending perpendicularly from back wall 66 toward arm 48, and between side member 50 and upturned end wall 67. Lip 68 extends along the side of ledge 64 opposite and parallel to back wall 66. End wall 67 is spaced from the ends of back wall 66 and lip 68 to form groove 80. Recess 72, of generally U-shaped configuration, is formed in outer end surface 74 of arm 46, and ledge 76 extends along one side. Portion 78 of ledge 76 extends outwardly in spaced, opposed relation to groove 80 and end wall 67.

Arm 48 includes angled surface 82 which is contacted by one of the plug blades to effect lateral movement of the shutter element during plug insertion, as explained later. Surface 83 is parallel to and between planes A and B. Shoulder 85 is contiguous with surface 83 adjacent the free end of arm 48. A pair of spaced protrusions 84 extend toward arm 46. The outer and inner surfaces of arms 46 and 48 and side member 50 lie in common, outer and inner planes A and B, respectively. It will be noted that arm 48 is shorter than arm 46.

Figure 10:
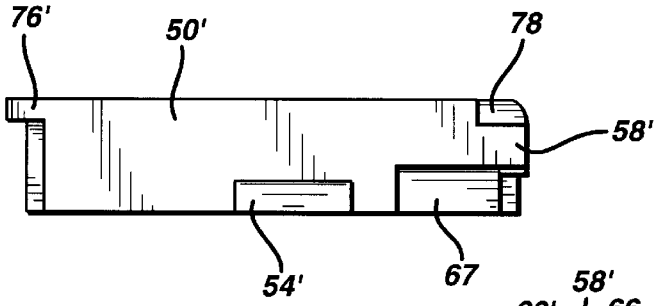
FIGS. 10 and 11 are side elevational views of the pair of shutter elements shown in what are termed relatively closed and open positions, respectively.
Figure 11:
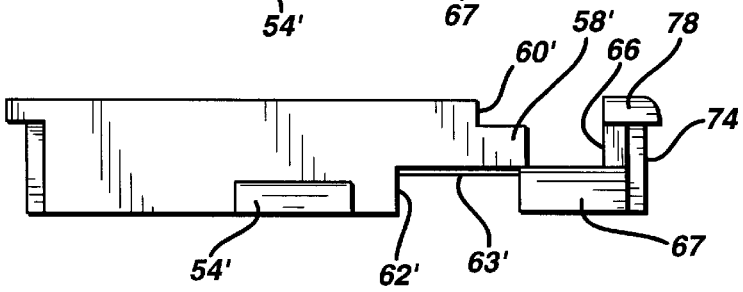
Figure 12:
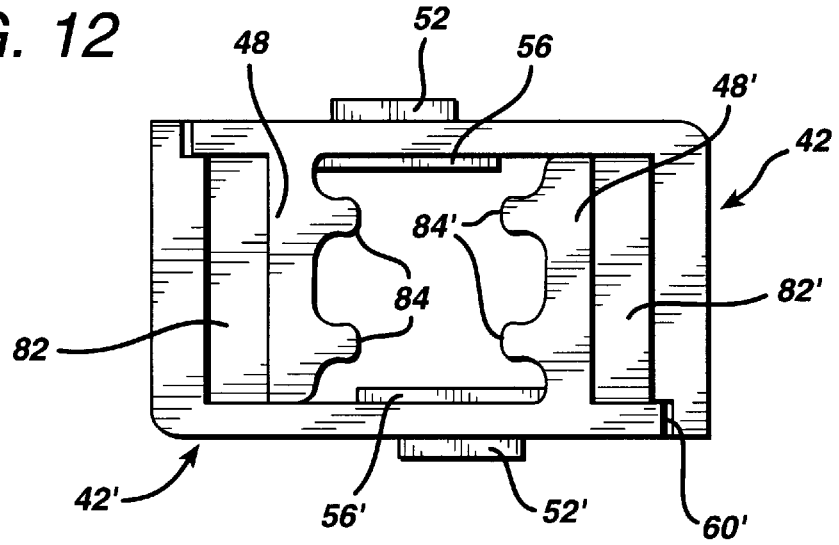
FIGS. 12 and 13 are top plan views of the assembled shutter elements in the closed and open positions, respectively.
Figure 13:
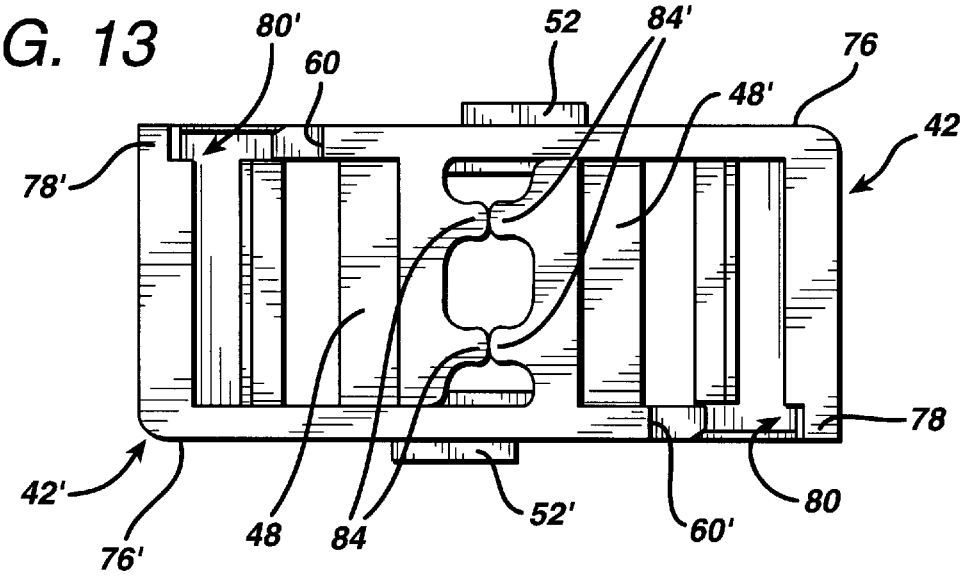

Turning now to FIGS. 9–13, the cooperative relationship of the structural features of a pair of identical, mutually assembled shutter elements will now be explained. Shutter elements 42 and 42' are placed in mutually assembled relation with side members 50, 50' outermost to form a complete shutter subassembly. When so assembled, the shutter elements are relatively moveable, with certain portions in sliding contact, between two terminal positions. Shutter elements 42 and 42' are shown in FIGS. 10 and 12 in what is termed the "closed" position since they are disposed with surfaces 82, 82' as well as ledges 64, 64' directly between the plug-receiving openings in cover 14 and the female contacts of terminals 18 and 32 when in this position within receptacle 10. When in the "open" position, shown in FIGS. 11 and 13, the shutter elements are removed from alignment with the plug-receiving openings, permitting insertion of the plug blades into the female contacts of terminals 18, 32, as explained later.

The closed position is defined by abutting contact of shoulders 60, 60' and 62, 62' with the opposing edges of portions 78', 78 and end walls 67', 67, respectively. Ribs 63, 63' are engaged in grooves 80', 80, respectively, as the end portions of each side member are retained between portions 78, 78' and end walls 67, 67' of the other element. Surfaces 83, 83' are superposed with ledges 64, 64' and lips 68, 68'.

During at least the major portion of relative movement of the shutter elements, ribs 63, 63' remain engaged in grooves 80', 80, respectively, with portions 58, 58' slidingly supported on the upper surface of end walls 67', 67, respectively. During the latter portion of movement toward and the initial portion of movement away from the open position, shoulders 85, 85' are slidingly supported upon the upper surfaces of ledges 56', 56, respectively. The cooperative structural and functional features of the shutter elements, as well as the manner of their movement, will be returned to after individual description of the other receptacle components.

Spacer member 36 is shown in detail in FIGS. 14–18. The side of spacer 36 shown in FIG. 14 faces cover 14 in the assembled condition of the receptacle, and is therefore termed the top side. A first pair of enclosed, elongated, parallel slots 90, 90' lie between a second pair of slots 92, 92' at one end of spacer 36. A pair of open-ended slots 94, 94' lie between another pair of enclosed slots 96, 96' at the other end. When a plug is inserted in receptacle 10 the blades pass through slots 92, 92', or 96, 96', slots 92 and 96 being somewhat longer than slots 92' and 96' to accept the wider blade of a polarized plug.

Figures 14, 15, 16, 17, 18:
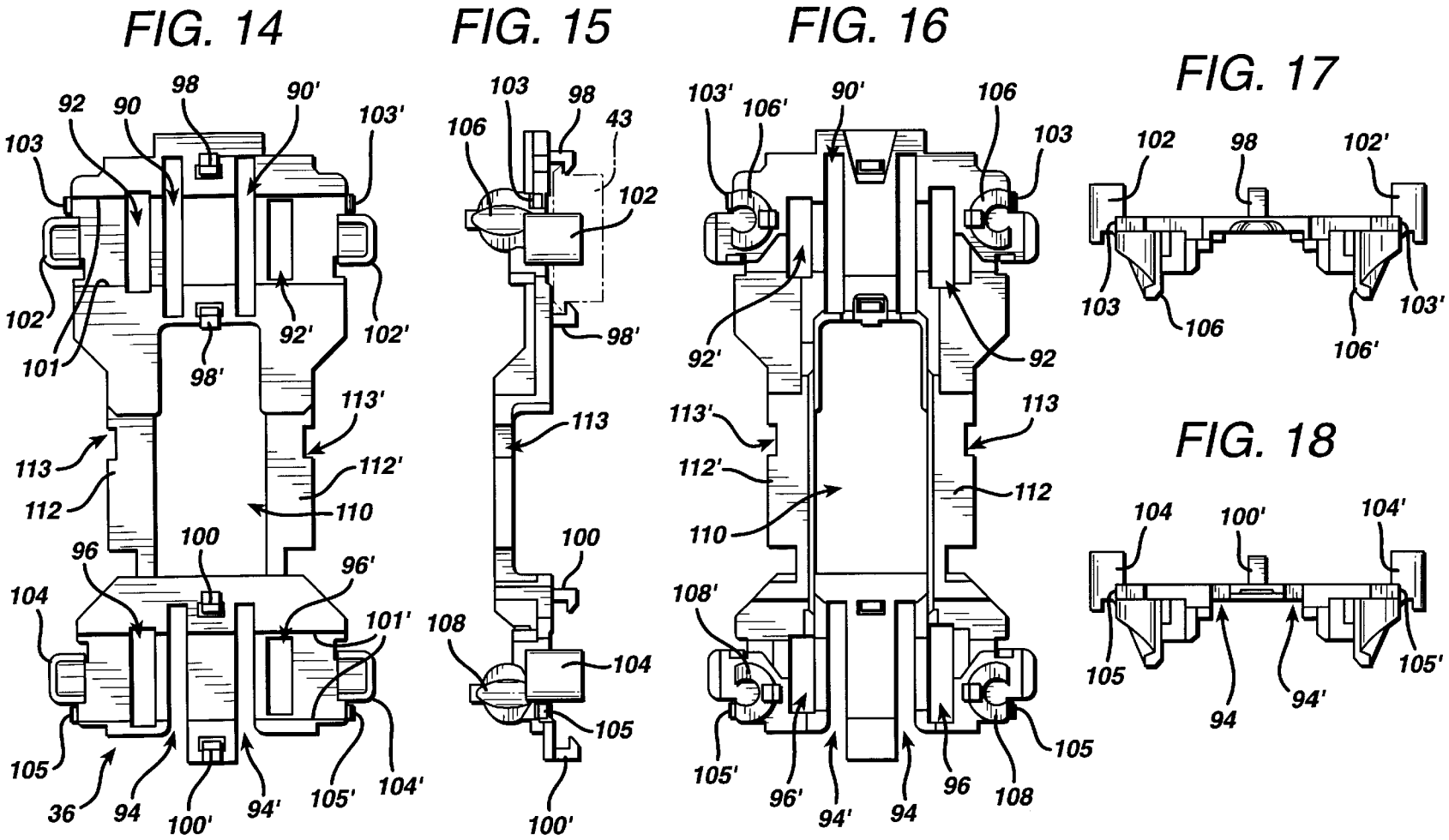
FIGS. 14–18 are top, side, bottom, front and rear views, respectively, of the spacer member.

A pair of flexible arms 98, 98' extend integrally from the top surface of spacer 36 between opposite ends of slots 90, 90'. Another pair of flexible arms 100, 100', identical to one another and to arms 98, 98' extend from the top surface essentially between opposite ends of slots 94, 94'. As best seen in FIG. 15, the free ends of arms 98, 98' terminate in hooked portions directed toward one another, as do the free ends of arms 100, 100'. Although more detailed descriptions of preferred procedures for assembly of receptacle 10 and relative positions of the fully assembled elements appear later herein, the outline in phantom lines of a shutter subassembly 43 retained by hooked arms 98, 98' is shown in FIG. 15. The position of the top surface (seen in FIG. 14) between lines 101, extending across the full width of spacer 36, is recessed a short distance (e.g., 0.010") from the surface portions on each side thereof. Thus, shutter subassembly 43 is supported only on its lateral edges, as is apparent in FIG. 15, thereby reducing the frictional forces opposing sliding movement of the shutter elements upon the spacer surface. The same is true of the surface portion between lines 101' at the opposite end of spacer 36.

A pair of U-shaped wall members 102, 102' extend from the top side of spacer 36 on opposite sides of slots 92, 92', and another pair of identical U-shaped wall members 104, 104' are positioned on opposite sides of slots 96, 96'. The open sides of each pair of wall members face inwardly toward one another. Small, flexible tabs 103, 103' are positioned adjacent wall members 102, 102', and tabs 105, 105' are adjacent wall members 104, 104'.

Other significant features of spacer 36 include two pair of wall members 106, 106' and 108, 108' of substantially semi-cylindrical shape extending integrally from the bottom side of spacer 36, essentially at the four corners thereof. When receptacle 10 is fully assembled, each of these wall members is positioned adjacent one of the female contacts of the terminal and serves as a stiff spring, opposing movement of the contact as a plug blade is inserted therein. In previously mentioned U.S. Pat. No. 5,472,350 identical wall members were provided for the same purpose on the inner side of the receptacle cover. Thus, the springlike wall members and their useful function have been retained in the safety receptacle of the present invention, being moved from the cover to the spacer. Opening 110 in the central portion of spacer 36 lies between wall portions 112, 112' which are offset from the planes of the wall portions at each end to permit another important feature of the receptacle of the prior patent to be retained, as explained later. Notches 113, 113' extend into the outer edges of wall portions 112, 112', respectively.

Figure 22:
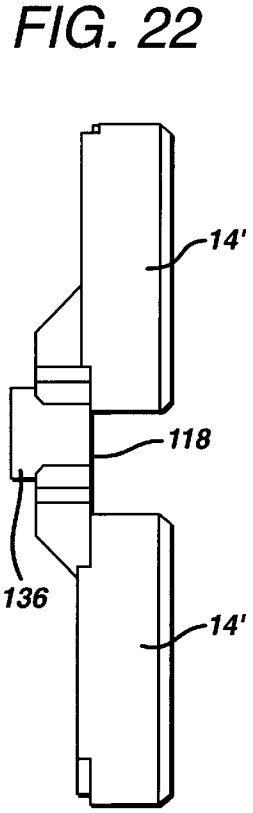
FIGS. 19–22 are top and bottom plan, side elevation in section on the line 21—21 of FIG. 19, and full side elevation views, respectively, of the cover member.
Figure 21:
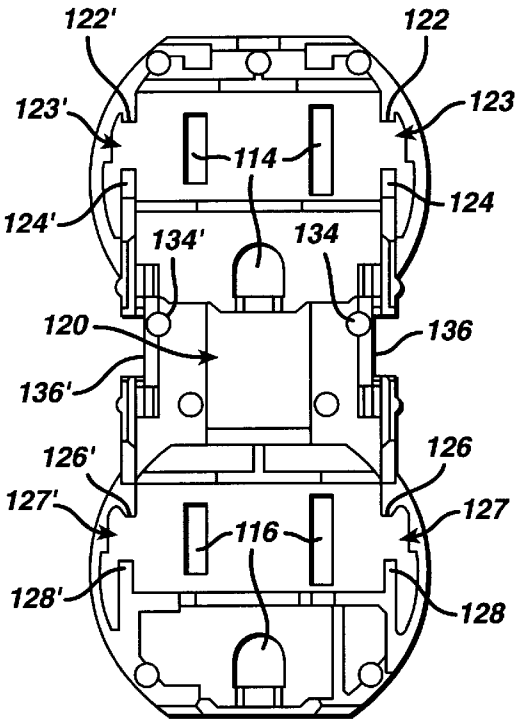
Figure 20:
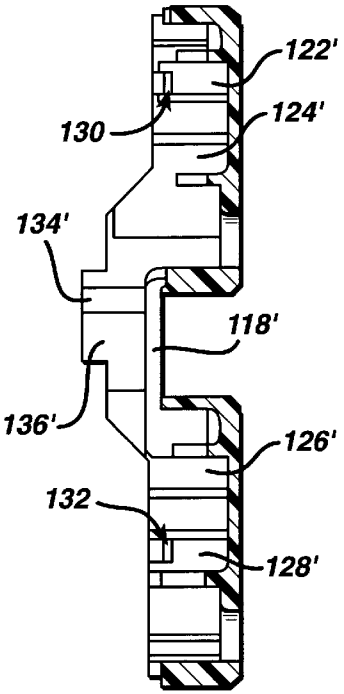
Figure 19:
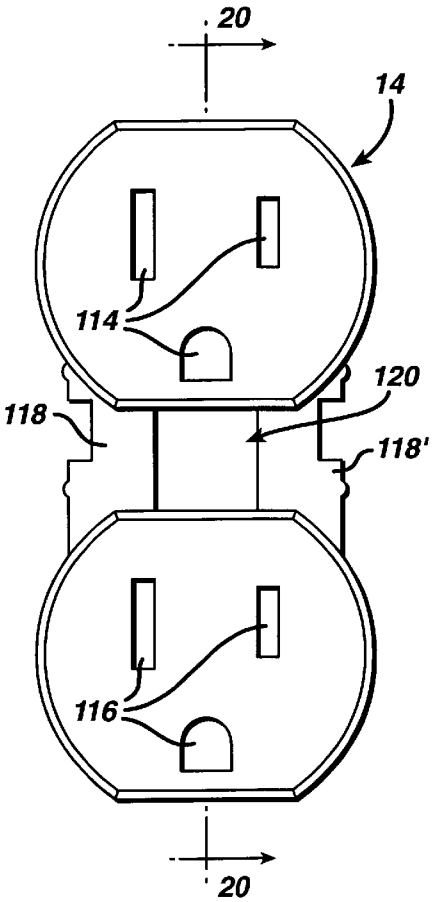

Details of cover 14 are shown in FIGS. 19–22. The usual two groups of through openings 114 and 116 are provided for insertion of the hot, neutral and ground prongs of standard electrical plugs into the corresponding female contacts of the duplex receptacle. The plane of central wall portions 118, 118', on each side of opening 120, is recessed from the outer surface planes of plug-receiving portions 14', as best seen in FIG. 22.

On the underside (FIG. 21) of cover 14, are wall portions, recesses, etc. configured for nesting fit of spacer 36. Of particular note are short wall portions 122, 122' having terminal edges in opposed, spaced relation to the terminal edges of wall portions 124, 124', providing open spaces or pockets 123, 123' on opposite sides of openings 114. Likewise, pocket 127, is provided between wall portions 126 and 128, and pocket 127' between wall portions 126' and 128' on opposite sides of openings 116. Also, as seen in the sectional view of FIG. 20, small grooves 130 and 132 are formed in the inwardly facing surfaces of wall portions 122' and 128', respectively. It will be understood that identical grooves (not shown) are formed in wall portions 122 and 128. Semicircular protrusions 134, 134' are provided integrally with side wall portions 136, 136', respectively.

The elements are configured for ease of automated assembly of receptacle 10. A preferred method of assembling the receptacle of aforementioned U.S. Pat. No. 5,472,350 is disclosed in U.S. Pat. No. 5,546,657. The present receptacle may be assembled by essentially the same method by attaching the spacer, with shutter subassemblies and springs in place, to the cover before placing the latter in covering relation to the back body. Spacer 36 is placed on a horizontal support and springs 38, 38' and 40, 40' are placed in coaxial pairs with one end of each spring in the pockets formed by U-shaped wall members 102, 102', 104, 104', respectively. As the springs are temporarily retained in position by magnets and grease sputs where their ends abut the U-shaped wall members, they are compressed by mechanical fingers sufficiently to permit placement of a shutter subassembly between each pair of springs. The subassemblies, in the closed position of FIGS. 10 and 12 and surfaces 82, 82' facing upwardly, are moved downwardly to rest upon the surfaces of spacer 36 between the springs. During such movement, the hooked ends of arms 98, 98', 100 and 100' will be cammed outwardly by angled surfaces 54, 54' of each subassembly, and the natural resilience of the arms will move them back to engage the hooked ends over protrusions 52, 52' when the shutter subassemblies are fully seated, as shown in FIG. 15. The springs are then released and one end of each is received in recesses 72, 72' in the outer ends of the shutter subassemblies. As the subassemblies are moved downwardly, the wider clearance at the open ends of recesses 72, 72' provides a lead-in for positioning the ends of the springs in the closed, curved ends of the recesses.

Cover 14 is then moved downwardly into mating engagement with spacer 36. When so positioned, U-shaped wall members 102, 102', 104, 104' are received in pockets 123, 123', 127, 127', and protrusions 134, 134' on the cover are received in notches 113, 113' of the spacer. Also, flexible tabs 103' and 105' are received in grooves 130 and 132, respectively, and tabs 103, 105 are received in the grooves in wall portions 123 and 128, providing a snap fit connection between cover 14 and spacer 36. Cover 14, with spacer 36 attached and the shutter subassemblies and springs contained between the cover and spacer, is then moved into covering relation with back body 12. Adjoining surfaces of back body 12 and cover 14 are ultrasonically welded to complete permanent assembly of the receptacle, wherein the central surface portion of strap 16 is exposed in opening 120 and is coplanar with the surfaces of wall portions 118, 118' of cover 14.

Figure 23:
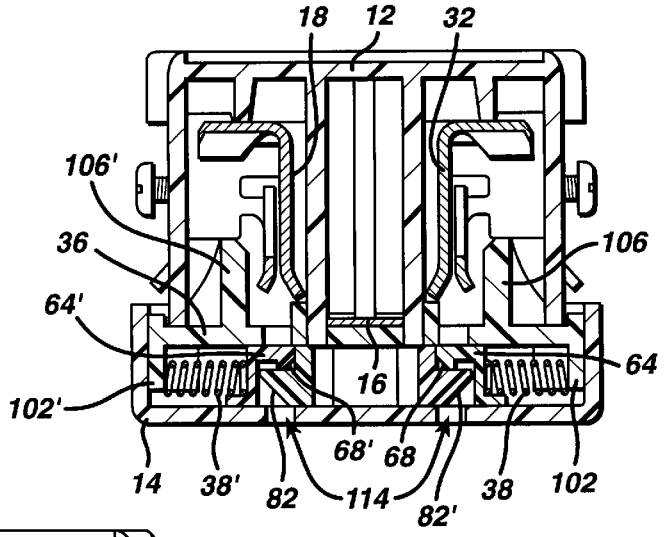
FIGS. 23–25 are end elevational views, each in section on the line 23—23 of FIG. 1, showing the rest positions of the shutter elements within the receptacle, and their deflected positions during improper and proper insertion operations, respectively.
Figure 24:
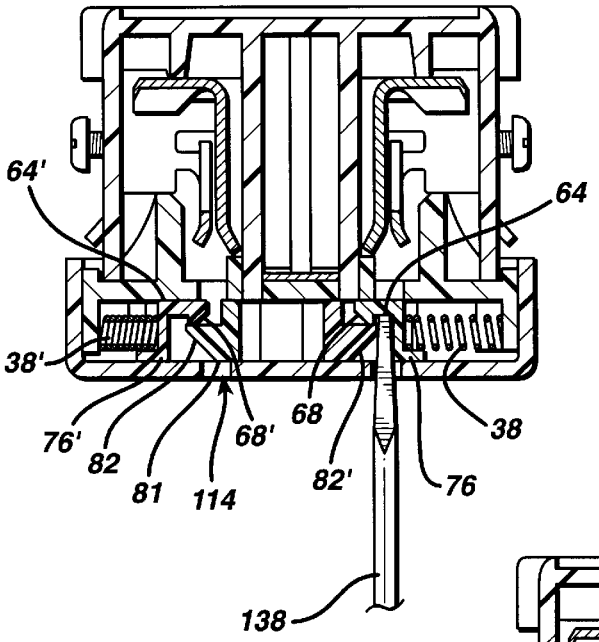
Figure 25:
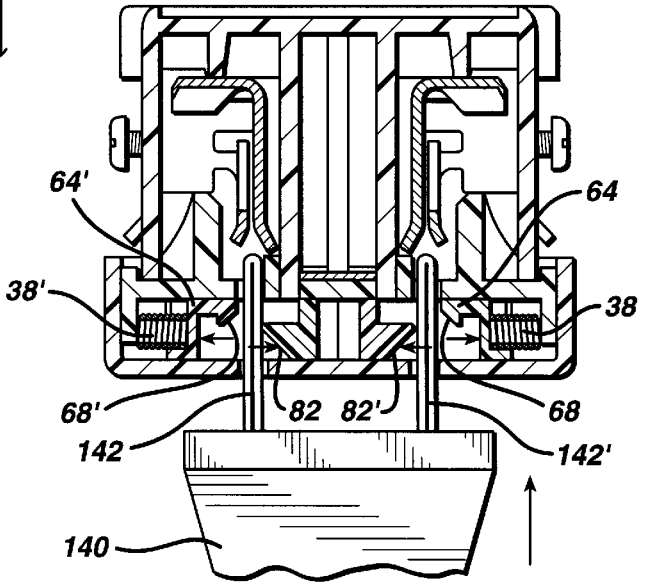

FIGS. 23–25 show the fully assembled receptacle in section through one of the shutter subassemblies and illustrate the operation thereof during both improper and proper utilization of the receptacle. The subassembly, consisting of shutter elements 42, 42', is shown in FIG. 23 in its centered or "rest" position wherein it is normally maintained by the equal biasing forces of springs 38, 38' acting upon the outer end walls of the subassembly. It will be noted that both the camming portion of one shutter element and the blocking portion of the other element are positioned between each of the elongated openings 114 and the female contacts of terminals 18 and 32 when the shutter subassembly is in its rest position.

In FIG. 24 a screwdriver blade 138 has been inserted through one of openings 114, i.e., the opening on the right-hand side. As the blade is so moved, its tip contacts angled surface 82' of the camming portion of shutter element 42'. As blade 138 is advanced, the tip slides over surface 82', camming the entire shutter element 42' toward the left as viewed in FIG. 24, thereby compressing spring 38'. Since the shutter elements are linearly moveable in either direction from the rest position, spring 38 moves shutter element 42 a short distance toward the left until further movement is prevented by contact of back wall 66 of the blocking portion with blade 138. Spring 38 is expanded slightly in FIG. 24 from its position of FIG. 23, and planar (non-angled) surface 81 of the camming portion of shutter element 42 is in substantially covering relation to the one of openings 114 on the left-hand side; this effectively discourages, if not prevents insertion of a second device through this opening while the first device (blade 138) is inserted in the other opening.

Although screwdriver blade 138 has been advanced through one of openings 114, it cannot physically engage the female contacts or, for that matter, any portion of terminal 32 because further advance from the position of FIG. 24 is prevented by the blocking portion of shutter element 42. More specifically, ledge 64 of arm 46 is directly in the path of blade 138. In addition, and in contrast with prior art safety shutter mechanisms of this type, lip 68 extends along ledge 64 and serves as a barrier to any attempt to work blade 138, or any other foreign object, past the edge of ledge 64.

Utilization of receptacle 10 in the intended manner is illustrated in FIG. 25. Conventional electrical plug 140 includes male prongs 142 for insertion through the parallel, elongated pair of openings 114. Plug 140 may also include a ground prong, but such is not shown in FIG. 25 since it has no relation to the present invention. Angled surfaces 82 and 82' are contacted simultaneously by the tips of prongs 142 and 142', respectively. As plug 140 is advanced, shutter elements 42 and 42' are moved linearly toward the right and left, respectively, as indicated by the horizontal arrows, by action of the prongs on the camming portions of the two shutter elements. It should be noted, and is also apparent from inspection of FIG. 9, that the forward edges of lips 68, 68' are chamfered to provide additional camming surfaces for the plug prongs in the event the latter contact the blocking portions of the shutter elements during advance of the prongs into the female contacts. Both springs 38, 38' are compressed, and remain so until plug 140 is removed from engagement with receptacle 10, whereupon both shutter elements are moved simultaneously by the springs back to the FIG. 23 rest position of the shutter subassembly.

From the foregoing it is apparent that the present invention provides an electrical receptacle with safety shutter structure having many novel and advantageous features, including:

a. compatibility of shutter structure with existing receptacles;

b. incorporation of safety shutters in receptacles with straight (non-wrap around) straps;

c. complete shutter-equipped receptacle conducive to automated assembly;

d. a shutter subassembly wherein both of two shutter elements are moveable in either of two opposite directions from a centered position;

e. a pair of shutter elements mounted for reciprocal, sliding movement upon a support surface with reduced friction;

f. safety shutter members having anti-defeating structure, i.e., enhanced safety features;

g. a one-piece spacer provides support, positioning and guiding of the shutter elements, as well as incorporating structure for biasing terminal contacts.

What is claimed is:

1. An electrical receptacle comprising:

a) a cover having at least two through openings configured and arranged for passage of blades of a conventional electrical plug;

b) a back body held in operatively assembled relation with said cover to form an enclosed housing;

c) first and second shutter elements each having a side member and first and second arms extending in spaced, parallel relation from the side member, the first arms of the first and second shutter elements having first and second camming surfaces, respectively, the second arms of the first and second shutter elements defining first and second blocking members, respectively; and, d) support means supporting each of said shutter elements within said housing for linear, lateral movement in either of two opposite directions from a rest position;

wherein, in the rest position, the camming surfaces are disposed directly behind respective ones of said through openings, the first blocking member is disposed directly behind the second camming surface, and the second blocking member is disposed directly behind the first camming surface, and upon simultaneous insertion of a pair of blades, the first and second camming surfaces are moved in linearly opposite directions, and upon improper insertion of a single blade, the first camming surface will move in one linear, lateral direction allowing a blade to push itself past the camming surface, but the second blocking member disposed behind the first camming surface will remain substantially stationary thereby blocking entry of a blade into the back body.

2. The invention according to claim 1 further comprising first and second springs, each having a first end engaged with a stationary portion of said receptacle and a second end engaged with a respective one of said shutter elements.

3. The invention according to claim 2 wherein each of said springs is partially compressed when its respective shutter element is in its rest position, said springs being expanded and compressed by movement of its respective shutter element in first and second, opposite directions, respectively, from said rest position.

4. The invention according to claim 3 wherein said first and second springs are positioned coaxially, outwardly of said first and second shutter elements.

5. The invention according to claim 1 wherein said first and second shutter elements are substantially identical to one another.

6. The invention according to claim 5 wherein each of said shutter elements is a unitary, molded plastic part.

7. The invention according to claim 1 and further comprising a spacer member positioned within said housing and having parts defining said support means.

8. The invention according to claim 7 wherein said cover and said spacer member include cooperative engagement means for resilient coupling of said spacer member to said cover.

9. The invention according to claim 8 wherein said spacer member includes a pair of integral post members positioned laterally adjacent terminal contacts within the back body to oppose movement thereof in response to insertion of blades of a plug.

10. A safety-type duplex electrical receptacle having two spaced sets of openings for passage therethrough of blades of electrical plugs to be received in female contacts of electrical terminals within said receptacle, comprising:

a) a back body;

b) a cover member having spaced portions each containing one of said two sets of openings and peripheral portions engaged with said back body to define an enclosed space containing said terminals; and c) first and second pairs of identical shutter elements, each of said elements including a camming portion and a blocking portion and each being constrained to a linear path within said enclosed space for movement between blocking and unblocking positions with respect to said two sets of openings to effectively prevent insertion of objects other than plug blades into said female contacts of said terminals.

11. The invention according to claim 10 and further including a spacer member of dielectric material positioned within said enclosed space and interposed between opposed, internal surface portions of said back body and said cover.

12. The invention according to claim 11 wherein all of said shutter elements are positioned between opposing surface portions of said spacer and cover members.

13. The invention according to claim 11 wherein said spacer member includes a plurality of integral obstruction members having terminal ends respectively positioned laterally adjacent portions of said female contacts to resiliently oppose movement of said contacts as a plug blade is inserted therein.

14. An electrical receptacle adapted to receive a pair of male plug blades, said receptacle comprising;

a) a base portion;

b) a cover portion affixed to said base portion to define therewith an internal cavity and having at least one pair of elongated openings configured and positioned for insertion therethrough of said plug blades;

d) a subassembly comprised of a pair of shutter elements each having a camming portion and a blocking portion;

e) wall means defining a cavity within said enclosed space wherein said subassembly is positioned, said wall means constraining movement of said subassembly within said cavity to a linear path; and f) spring means biasing said subassembly to a rest position along said linear path, said subassembly being reciprocally movable in both directions from said rest position to opposite terminal positions along said linear path, and said shutter elements being both independently and conjointly movable in directions opposite to one another, away from said rest position to said terminal positions along said linear path.

15. The invention according to claim 14 wherein said spring means comprise a pair of coil springs coaxially positioned within said cavity to exert biasing forces toward one another upon said subassembly.

16. The invention according to claim 15 wherein one end of each of said springs is positioned within fixed, pocket-like means within said cavity and the other end bears against a respective one of said shutter elements.

17. The invention according to claim 14 wherein a first portion of said wall means is integral to said cover member.

18. The invention according to claim 17 and further including a spacer member and wherein a second portion of said wall means is integral to said spacer member.

19. The invention according to claim 18 wherein said subassembly and said spacer member include cooperative, snap-fit engagement means.

20. An electrical receptacle for receiving at least two blades of a plug, said receptacle comprising:

a) a cover having a pair of openings adapted to receive blades of a plug, said openings being elongated along parallel axes;

b) a pair of shutter elements each having a camming portion and a blocking portion;

c) support for said shutter elements permitting linear movement thereof in opposite directions transverse to a direction of insertion of blades of a plug; and d) at least one spring biasing said shutter elements to a rest position wherein said camming portions are respectively positioned directly behind said pair of openings; wherein, e) each of said blocking portions includes an elongated edge parallel to said axes, a blocking surface facing said openings and a lip extending along said edge adjacent said blocking surface and in the direction of said openings to effectively prevent passage of objects past said blocking portions of shutter elements in or near said rest position.

* * * * *